US005806570A

United States Patent [19]

Speich

[11] Patent Number: 5,806,570

[45] Date of Patent: Sep. 15, 1998

[54] WEFT BAND GUIDE PIN ARRANGEMENT IN A GRIPPER WEAVING MACHINE

[75] Inventor: Francisco Speich, Gipf-Oberfrick, Switzerland

[73] Assignee: Textilma AG, Hergiswil, Switzerland

[21] Appl. No.: 793,056

[22] PCT Filed: Jul. 25, 1995

[86] PCT No.: PCT/CH95/00167

§ 371 Date: Feb. 14, 1997

§ 102(e) Date: Feb. 14, 1997

[87] PCT Pub. No.: WO96/05344

PCT Pub. Date: Feb. 22, 1996

[30] Foreign Application Priority Data

Aug. 16, 1994 [DE] Germany ..... 94 13 172 U

[51] Int. Cl.[6] ..... D03D 47/27; D03D 47/12

[52] U.S. Cl. ..... 139/449

[58] Field of Search ..... 139/449

[56] References Cited

U.S. PATENT DOCUMENTS

| | | | |
|---|---|---|---|
| 4,638,839 | 1/1987 | Pezzoli . | |
| 4,834,146 | 5/1989 | Pezzoli | 139/449 |
| 5,092,374 | 3/1992 | Riolet et al. | 139/449 |
| 5,176,185 | 1/1993 | Rheinganz et al. | 139/449 |

FOREIGN PATENT DOCUMENTS

| | | | |
|---|---|---|---|
| 0137376 | 4/1985 | European Pat. Off. . | |
| 0 199 881 | 11/1986 | European Pat. Off. | 139/449 |
| 0352223 | 1/1990 | European Pat. Off. . | |
| 0406926 | 1/1991 | European Pat. Off. . | |
| 0552495 | 7/1993 | European Pat. Off. . | |
| 682572 | 10/1993 | Switzerland . | |

*Primary Examiner*—Andy Falik
*Attorney, Agent, or Firm*—Friedrich Kueffner

[57] ABSTRACT

A gripper weaving machine has at least one gripper which is arranged at weft band and guided so as to reciprocate in a shed. The weft band is guided in the shed on both sides in guide recesses of guide pins at a distance from the warp threads. Each of the guide recesses of the guide pins adjacent a weaving reed has a lower guide surface which ends at least parallel to the plane of the weft band and an upper guide surface opening toward the weft band at an angle relative to the plane of the weft band. The edge of the weft band engaging in the guide recesses has a cross section adapted to the shape of the guide recesses. The angle of the upper surface of the guide pins adjacent to the weaving reed is dimensioned such that the upper guide surface, when exiting from the lower shed and intersecting the warp threads, forms an angle with the warp threads which is greater than or equal to 5 degrees. In addition, the weft band has a protruding portion on the underside and between the edges of the weft band.

9 Claims, 3 Drawing Sheets

WEFT BAND GUIDE PIN ARRANGEMENT IN A GRIPPER WEAVING MACHINE

BACKGROUND OF THE INVENTION

1. Field of the Invention

The invention is directed to a gripper weaving machine in accordance with the preamble of claim 1.

2. Description of the Related Art

Gripper weaving machines of the type mentioned above are known, for example, from EP-OS 0 137 376 which is described more fully in the accompanying FIG. 1. The problem in gripper weaving machines of this kind consists in that when the guide pins emerge from the weaving shed, the guide pins on the weaving reed side can hook onto the warp threads resulting in broken warp threads and malfunctioning. Further, selvage threads or edge threads lying on the weft band and/or incorrectly placed foundation warp threads can get caught between the weft band and the guide recess of a guide pin during the movement of the weft band, which can again lead to malfunction and/or warp thread breakage. This catching is abetted especially by wear marks caused by sliding, e.g., chatter marks, which can form at the edges of the weft band guided in the guide pins and can carry along contacting threads.

Further, CH-PS 682 572 discloses gripper weaving machines in which the weft band and the gripper rest upon the warp threads and wherein guidance is effected between guide pins. In this regard, it is disadvantageous that movement is hampered due to the fact that the weft band and gripper lie on the warp threads and the warp threads are subjected to a severe strain, so that only warp threads of a certain level of quality can be used.

SUMMARY OF THE INVENTION

The object of the invention is to improve a gripper weaving machine of the type mentioned above.

In accordance with the present invention, the gripper weaving machine has at least one gripper which is arranged at a weft band and guided in reciprocating motion in a shed, wherein the weft band in the shed is guided on both sides at guide pins in guide recesses at a distance from the warp threads. Each of the guide recesses of the guide pins facing the weaving reed has a lower guide surface which runs out at least parallel to the plane of the weft band and an upper guide surface opening toward the weft band at an angle relative to the plane of the weft band, wherein the edge of the weft band engaging in the guide recesses has an adapted cross section and the weft band has a protruding portion on the underside between the edges.

To prevent the guide pins from hooking the warp threads when emerging from the weaving shed and crossing the warp threads, especially those of the lower shed, and thus to prevent malfunction and/or breakage of warp threads, an upper guide surface of the guide pins facing the weaving reed opens toward the weft band at an angle $\alpha$ relative to the plane of the weft band, wherein, further, the edge of the weft band is adapted in cross section. Moreover, this construction makes it more difficult for warp threads lying on the weft band to become caught in the slit between the guide recesses and weft band. A construction on the underside of the weft band between its guiding edges prevents threads from being carried along and caught in the slit between the guide recesses and the weft band. This substantially improves the dependability of operation of the gripper weaving machine.

Due to the fact that the gripper and the weft band are guided without contacting or resting upon the warp threads, no friction is generated at the warp threads on the one hand and the risk of the warp threads catching in the slit between the guide recesses and weft band is prevented on the other hand. Thus, it is possible to work with very weak and inexpensive yarns. This construction further allows the gripper and the weft band to run through the shed cleanly and with low vibrations and low noise. Accordingly, the guiding of the gripper and weft band is also not sensitive to soiling which can occur, for example, as a result of accumulated sizing materials or dust.

The solution according to the invention substantially reduces malfunctions and wear at the weft band and/or damage to warp threads, in addition to reducing the noise level, and substantially increases the service life and efficiency of the gripper weaving machine. This construction of the gripper weaving machine provides the further important advantage that it can be operated at higher speeds of up to 1,500 rpm, for instance.

The upper guide surface and the lower guide surface of the guide recesses can have an angular or edged connection in cross section. However, in a particularly advantageous embodiment, a circular-arc-shaped connecting surface improves the sliding effect and reduces tensions.

The angle $\alpha$ formed by the upper guide surface relative to the plane of the weft band is advantageously equal to 20°–70°. In accordance with another feature, the upper guide surface of the guide recess forms an angle greater than or equal to 5 degrees with the warp threads when emerging form the lower shed and crossing the warp threads. In addition, the guide recesses of the guide pins remote of the reed have upper and lower guide surface which are parallel to one another and parallel to the weft band plane, and the edge of the weft band has an adapted cross-section. However, a construction similar to the guide recesses of the guide pins facing the weaving reed is also possible.

In principle, it is not necessary that the profile of the guide recess conform to the profile of the guiding edge at the weft-band. However, especially advantageous operating conditions result when the upper and lower guide surfaces are connected with one another by a connecting surface perpendicular thereto.

The weft band can have a flat, straight surface on top between the guiding edges. But a construction of the gripper weaving machine in which the weft band also has a construction on the top side between the edges, is especially advantageous. Accordingly, any threads resting on the weft band lie outside the slit between the guide recesses and the guiding edges of the weft band, and threads resting on the weft band for whatever reason, e.g., when the change of warp threads is faulty or the change of shed is set too soon, are prevented from entering the slit between the guide recesses and the guiding edge of the weft band. This results in optimum thread guidance at the guide of the gripper and weft band and the time point at which the shed crossing takes place has no bearing upon the guiding of the gripper. This construction adds to the advantages of the solution according to the invention which were already discussed above.

BRIEF DESCRIPTION OF THE DRAWINGS

In the following, the invention is described more fully with reference to embodiment examples.

DESCRIPTION OF THE PREFERRED EMBODIMENTS

Figure 1:
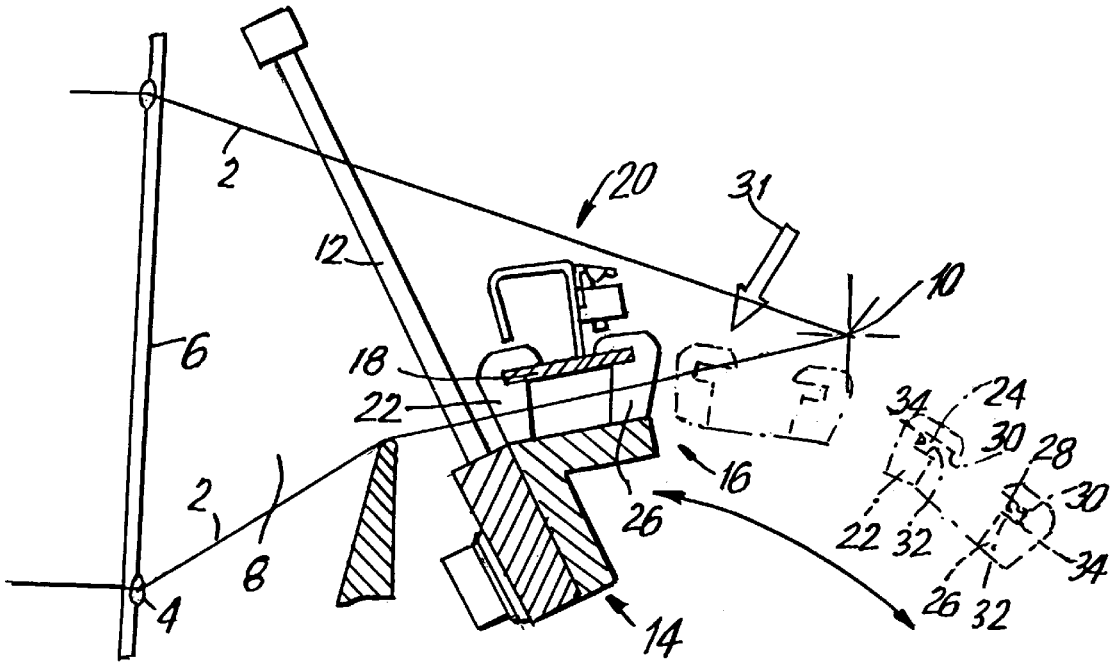
PRIOR ART FIG. 1
FIG. 1 is a side view in partial section showing a known construction of the guide means of a gripper and of a weft band at a batten.

FIG. 1 shows a gripper Weaving machine which is known, for example, from EP-OS 0 137 376, in which warp threads 2 are guided by thread eyelets 4 at heald shafts 6 and are opened to form a weaving shed 8. The warp threads converge at a selvage 10, also referred to as selvedge, at which a filling yarn or pick of weft, not shown in greater detail, is beat up by a weaving reed 12. The latter is attached to a batten 14 which supports a guide arrangement 16 for a weft band 18 and a gripper 20 attached thereto. The guide arrangement 16 contains a first row of guide pins 22 which face the weaving reed 12 and have guide recesses 24. A second row of guide pins 26 is arranged on the side remote of the weaving reed 12 and contains guide recesses 28 for the weft band. The guide recesses 24 of the first row of guide pins 22 as well as the guide recesses 28 of guide pins 26 have parallel upper and lower guide surfaces 30, 32 which are connected with one another by transversely extending connecting surfaces 34. As will be clear from FIG. 1, warp threads 2 resting on the weft band 18 can become caught in the slit between the weft band 18 and guide recesses 24, 28. Also, the upper guide surface 30 of the guide recesses 24 of the first row of guide pins 22 can hook a warp thread 2 when the guide pins are swiveled out of the shed or cross a warp thread. This is indicated by arrow 31 in FIG. 1.

Figure 2:
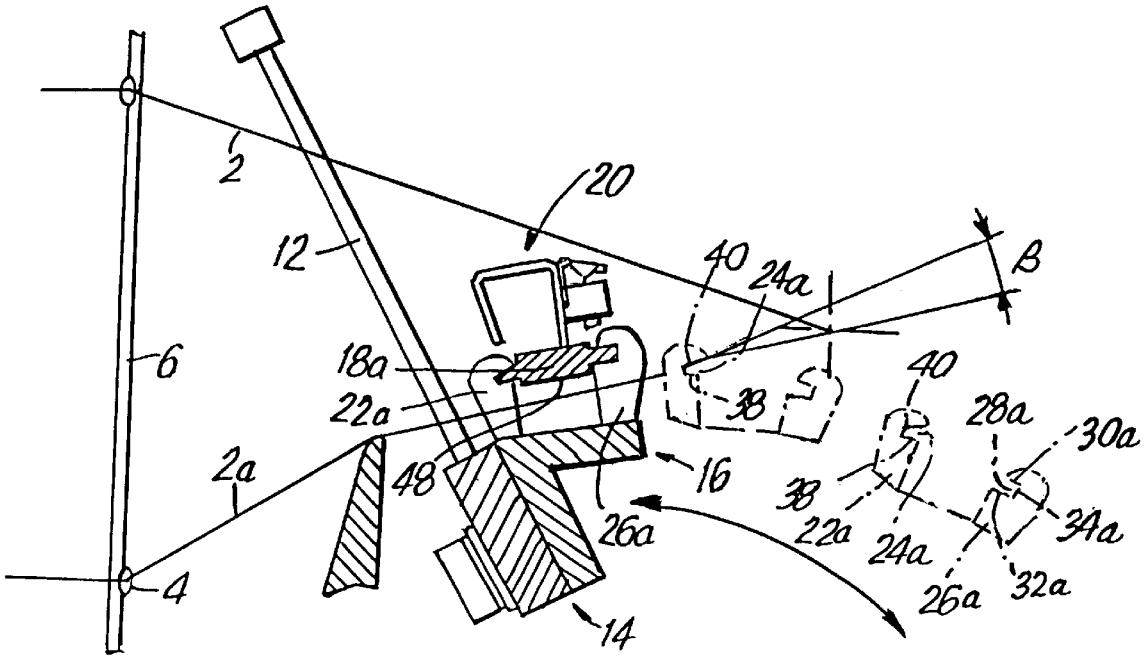
FIG. 2 shows the same gripper weaving machine illustrated in FIG. 1, but with a guide arrangement in accordance with the present invention.
Figure 5:
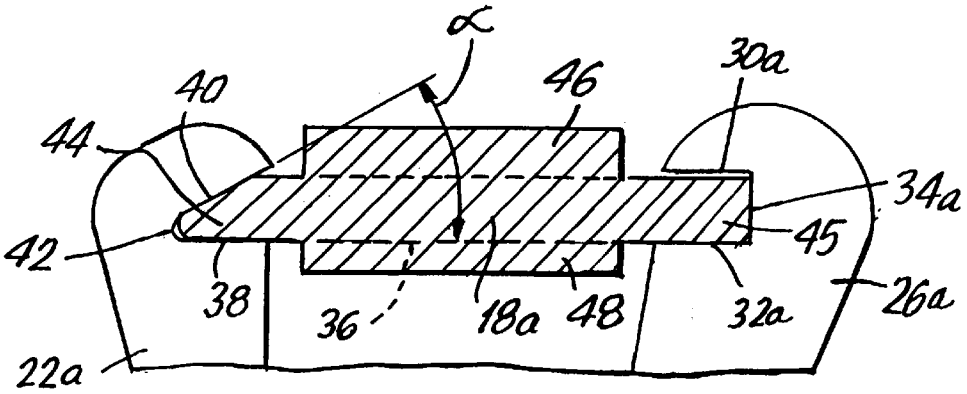
FIG. 5 shows an enlarged view of the guiding of a weft band at the guide pins in cross section in the longitudinal direction of the weft band.

FIG. 2 shows a gripper weaving machine, according to the invention, which has a weft band 18*a*, shown in more detail in FIG. 5, for example, and first guide pins 22*a* and second guide pins 26*a*. The guide recesses 28*a* of the second row of guide pins 26*a* have upper guide surfaces 30*a* and lower guide surfaces 32*a* which extend parallel to one another and parallel to the weft band plane 36 and are connected with one another via a vertical connecting surface 34*a* in the base of the recess. On the other hand, the first row of guide pins 22*a* has guide recesses 24*a* having a lower guide surface 38 which extends parallel to the weft band plane 36. The upper guide surface 40, however, is inclined at an angle α to the weft band plane 36 and opens toward the weft band 18*a*, wherein the lower guide surface 38 and the upper guide surface 40 are connected with one another via a connecting surface 42 forming a small circular arc in cross section in the example illustrated in FIG. 5. The guiding edges 44, 45 of the weft band are adapted to the guide recesses 24*a*, 28*a*, i.e., in the present example, they are constructed so has to be congruent to these guide recesses. The weft band 18*a* is provided with an upper construction or protruding portion 46 and a lower construction or protruding portion 48 which have a height such that a warp thread resting upon the weft band 18*a* cannot enter the slit between the guide recesses 24*a*, 28*a* and the edges 44, 45 of the weft band 18*a*. In the example shown in FIG. 5, the weft band is formed of a suitably profiled solid material. The height of the upper construction 46 can be 0.5 mm, for example.

The angle α at which the upper guide surface 40 is inclined relative to the lower guide surface 38 can be 20° to 70°, for example. Angle α is advantageously selected in such a way that when the guide pin exits from or crosses the warp threads 2*a* of the lower shed, the upper guide surface 40 forms an angle β with the warp thread 2*a* which is greater than or equal to 5°. This makes it impossible for warp threads to catch at the guide recess 24*a* of the guide pins 22*a* as shown in FIG. 2.

Figure 3:
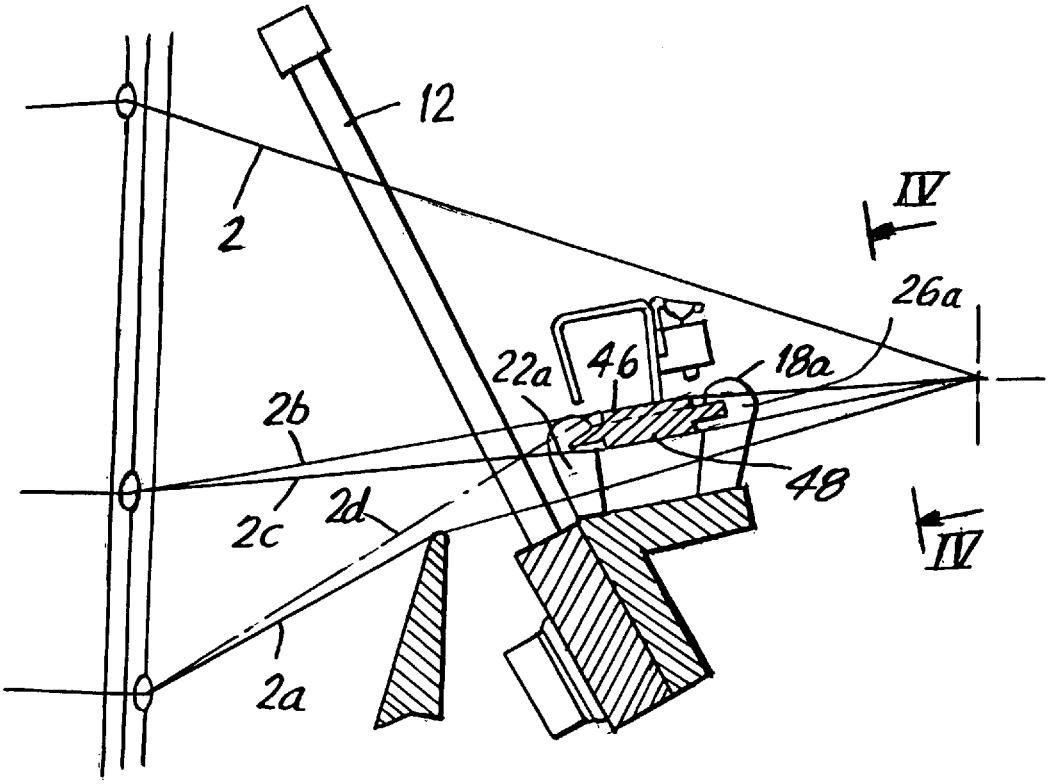
FIG. 3 shows the gripper weaving machine illustrated in FIG. 2 with different thread guides.
Figure 4:
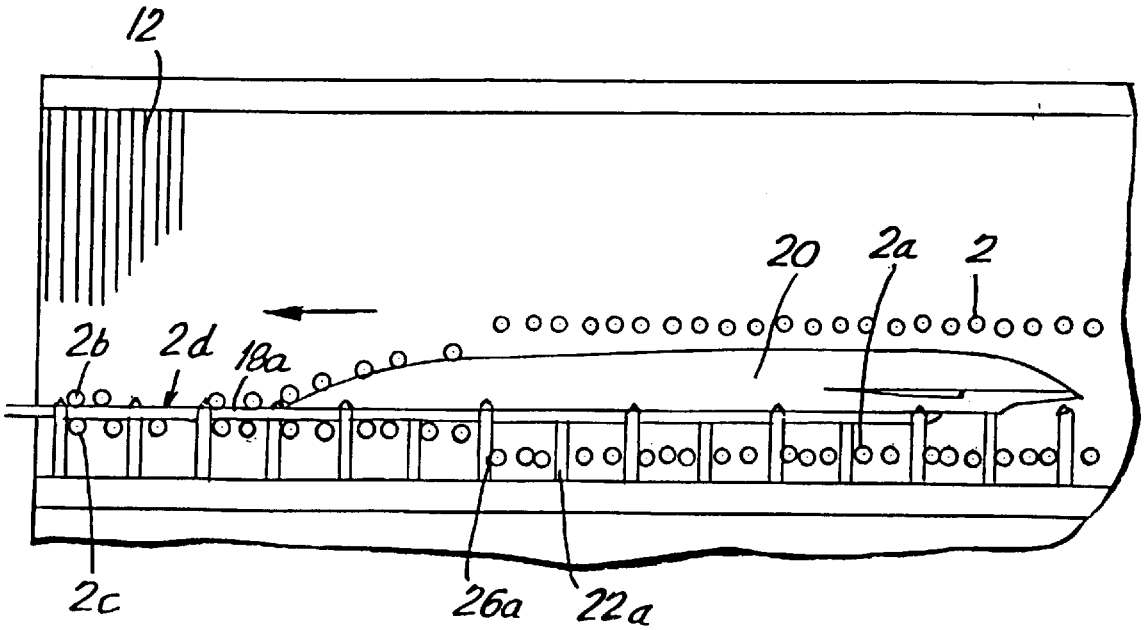
FIG. 4 shows the gripper weaving machine illustrated in FIG. 3 along section IV—IV from FIG. 3.

The advantageous effect of the gripper weaving machine according to the invention is further clarified with the aid of FIGS. 3 and 4. For example, it is ensured that selvage threads 2*b*, 2*c* which alternately contact the weft band 18*a* cannot enter the slit between the guide recesses 24*a*, 28*a* of the guide pins 22*a*, 26*a* because of the built-on structures 46, 48. This is also true for an incorrectly placed foundation warp thread 2*d* resting upon the top construction 46 of the weft band 18*a* in FIG. 3, for example.

Figure 6:
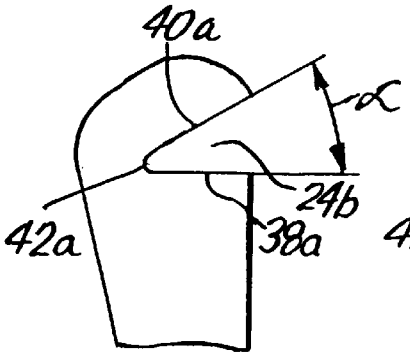
FIGS. 6 to 8 show different constructions of the guide recesses.
Figure 7:
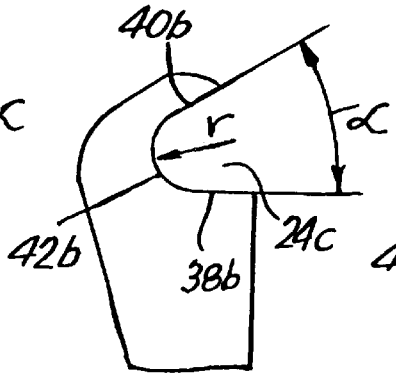
Figure 8:
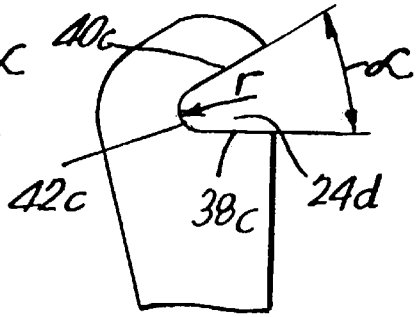

FIGS. 6 to 8 show different embodiment forms of the guide recesses 24*b*, 24*c*, 24*d* in which the lower guide surfaces 38*a*, 38*b*, 38*c* and the upper guide surface 40*a*, 40*b*, 40*c* are connected with one another via differently constructed connecting surfaces 42*a*, 42*b*, 42*c*. For example, the connecting surface 42*a* shown in FIG. 6 is provided with such a small radius that the upper guide surface 40*a* and the lower guide surface 38*a* practically meet at an edge or angle. In the construction shown in FIG. 7, however, the connecting surface 42*b* is provided with a large radius r so that the upper guide surface 40*b* and the lower guide surface 38*b* are still relatively short. In the embodiment form shown in FIG. 8, the configuration of the connecting surface 42*c* is approximately in the range between the embodiment forms in FIG. 6 and FIG. 7.

Figure 9:
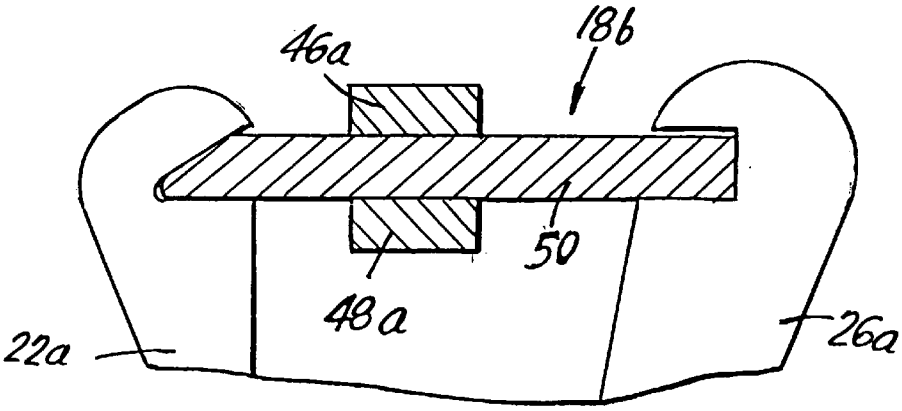
FIG. 9 shows another construction of the weft band in a view analogous to FIG. 5.

FIG. 9 shows another embodiment example of a weft band 18*b* in which an upper construction 46*a* and a lower construction 48*a* are not formed onto a base band 50, but rather are connected, e.g., glued or welded, with the base band 50 as separate strips of material.

I claim:

1. A gripper weaving machine comprising at least one gripper arranged at a weft band and guided so as to carry out a reciprocating motion in a shed, the weft band having edges and extending in a plane, the weft band being guided in the shed on both sides thereof at guide pins in guide recesses of the guide pins at a distance from warp threads, each of the guide recesses of the guide pins adjacent to a weaving reed having a lower guide surface which ends at least parallel to the plane of the weft band and an upper guide surface opening toward the weft band at an angle α relative to the plane of the weft band, wherein one of the edges of the weft band engaging in the guide recesses has a cross section adapted to a shape of the guide recesses, the angle α of the upper guide surface of the guide pins adjacent to the weaving reed being dimensioned such that the upper guide surface, when exiting from the lower shed and intersecting the warp threads, forms an angle β with the warp threads which is greater than or equal to 5 degrees, wherein the weft band has a protruding portion at an underside of the weft band between the edges thereof.

2. The gripper weaving machine according to claim 1, wherein the upper guide surface and the lower guide surface are connected to one another by a connecting surface having the shape of a circular arc in cross section.

3. The gripper weaving machine according to claim 1, wherein the angle α is 20 degrees to 70 degrees.

4. The gripper weaving machine according to claim 1, wherein the guide pins include guide pins facing away from the weaving reed, the guide recesses of the guide pins facing away from the weaving reed having upper and lower guide surfaces which extend parallel to one another and parallel to the plane of the weft band, and wherein a second of the edges of the weft band facing away from the weaving reed has a cross section adapted to a shape of the guide recesses of the guide pins facing away from the weaving reed.

5. The gripper weaving machine according to claim 4, wherein the upper and lower guide surfaces of the guide recesses of the guide pins facing away from the weaving reed are connected to one another by a connecting surface extending perpendicularly thereto.

6. The gripper weaving machine according to claim 1, wherein the guide recesses of the guide pins and the edges of the weft band are of congruent construction.

7. The gripper weaving machine according to claim 1, wherein the weft band has a protruding portion at an upper side thereof between the edges thereof.

8. The gripper weaving machine according to claim 1, wherein the protruding portion on the underside of the weft band has a thickness of at least 0.5 mm.

9. The gripper weaving machine according to claim 7, wherein the protruding portion on the upper side of the weft band has a thickness of at least 0.5 mm.

* * * * *